US006648495B1

(12) United States Patent
Hsu

(10) Patent No.: US 6,648,495 B1
(45) Date of Patent: Nov. 18, 2003

(54) HEAT-DISSIPATING LED TRAFFIC SIGNAL LIGHT

(76) Inventor: Run-Chi Hsu, 28F-2, No. 251, Chung-Ching Road, Pan-Chiao City, Taipei Hsien (TW)

( * ) Notice: Subject to any disclaimer, the term of this patent is extended or adjusted under 35 U.S.C. 154(b) by 0 days.

(21) Appl. No.: 10/176,872

(22) Filed: Jun. 19, 2002

(51) Int. Cl.[7] ..... F21Y 10/02; F21V 29/00

(52) U.S. Cl. ..... 362/545; 362/800; 362/547; 362/373; 362/294

(58) Field of Search ..... 362/800, 545, 362/546, 547, 373, 294

(56) References Cited

U.S. PATENT DOCUMENTS 5,036,248 A * 7/1991 McEwan et al. ..... 313/500
5,785,418 A * 7/1998 Hochstein ..... 362/373
6,019,493 A * 2/2000 Kuo et al. ..... 362/800
6,283,613 B1 * 9/2001 Shaffer ..... 362/245
6,367,949 B1 * 4/2002 Pederson ..... 362/240
6,509,840 B2 * 1/2003 Martineau ..... 340/815.45

* cited by examiner

*Primary Examiner*—Laura K. Tso

(57) ABSTRACT

A LED traffic signal light includes: a rear cover having a heat-dissipating device integrally formed on the rear cover, a front transparent cover combined with the rear cover for encasing a LED printed-circuit-board (PCB) and a power supply circuit device in the front and rear covers, and a plurality of packing rings respectively packed in between the front and rear covers for water proof purpose, whereby upon lighting of the LEDs in the traffic signal light, the heat as produced by the LEDs and power supply circuit will be dissipated outwardly effectively by the heat-dissipating device as formed on the rear cover for prolonging the service life of the traffic signal light.

14 Claims, 4 Drawing Sheets

HEAT-DISSIPATING LED TRAFFIC SIGNAL LIGHT

BACKGROUND OF THE INVENTION

A conventional LED traffic signal light includes a plastic cover (or casing) for encasing LEDs in the cover. However, the plastic cover can not dissipate heat outwardly effectively when the heat is emitted by the LEDs to thereby shorten the service life of the LED traffic signal light. For cooling purpose, an aperture may be circumferentially formed along the cover of the LED signal light, the environmental moisture or pollutants may then penetrate into the interior of the LED traffic signal light through such an aperture to thereby corrode or erode the LEDs and electric circuit in the light to shorten the service life of the light.

The present inventor has found the drawbacks of the conventional LED traffic signal light and invented the present LED traffic signal light for dissipating heat effectively.

SUMMARY OF THE INVENTION

The object of the present invention is to provide a LED traffic signal light including: a rear cover having a heat-dissipating device integrally formed on the rear cover, a front transparent cover combined with the rear cover for encasing a LED printed-circuit-board (PCB) and a power supply circuit device in the front and rear covers, and a plurality of packing rings respectively packed in between the front and rear covers for water proof purpose, whereby upon lighting of the LEDs in the traffic signal light, the heat as produced by the LEDs and power supply circuit will be dissipated outwardly effectively by the heat-dissipating device as formed on the rear cover for prolonging the service life of the traffic signal light.

DETAILED DESCRIPTION

Figure 1:
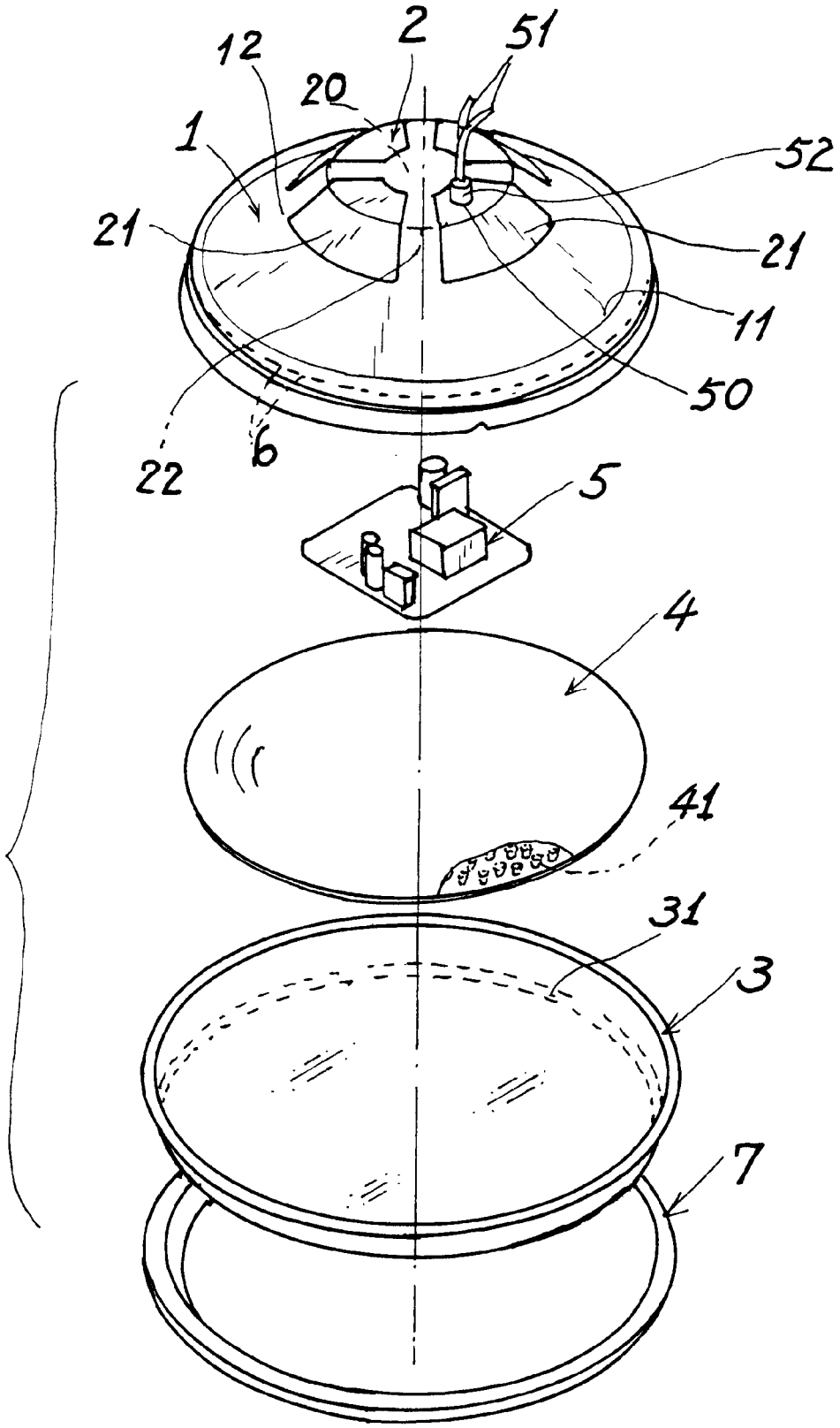
FIG. 1 is an exploded view showing the elements of the present invention.

As shown in FIGS. 1–5, the LED traffic signal light of the present invention comprises: a rear cover 1, a heat-dissipating device 2 formed on the rear cover 1, a front cover (or front transparent cover) 3 combined with the rear cover 1 for forming a housing of the traffic signal light of the present invention, a LED printed-circuit-board (PCB) 4 having a plurality of LEDs 41 formed thereon, and a power supply circuit device 5 electrically connected with the LED PCB 4 for powering the LEDs 41 for lighting purpose; with the LED PCB 4 and the power supply circuit device 5 mounted within the front and rear covers 3, 1.

The power supply circuit device 5 includes two electric wires 51 connected to a utility power source (not shown), a sealing plug 52 encasing the two electric wires 51 in the plug 52 as sealed by a sealant including silicon type sealant. The sealing plug 52 is inserted into an interior in between the rear cover 1 and the front cover 3 through a plug hole 50 formed through the rear cover 1 and having a water-proof sealant sealing any aperture existing in between the plug 52 and the plug hole 50 in the rear cover 1.

The rear cover 1 is made of plastic materials, while the front cover 3 may be made of transparent plastic materials, but not limited in the present invention.

The rear cover 1 includes a front flange 11 circumferentially formed on a front perimeter of the rear cover, and a rear portion 12 protruding rearwardly from the front flange 11 to form a conical, semi-spherical, truncated-cone shape or any other geometric shapes, not limited in the present invention.

Figure 5:
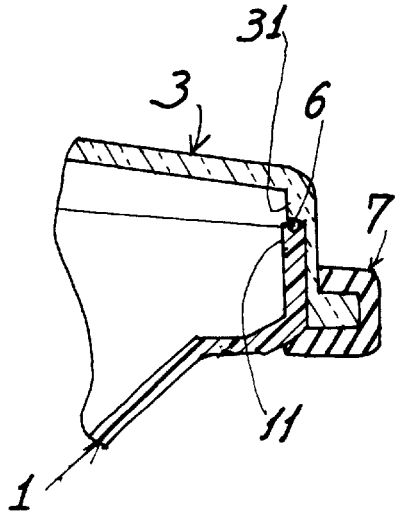
FIG. 5 is a partial sectional drawing showing the front and rear covers having a packing ring packed therebetween.

The front cover 3 includes a flange 31 circumferentially formed on a rim of the front cover 3 and engaged with the front flange 11 of the rear cover 1 having an inner packing ring 6 packed in between the flange 31 of the front cover 3 and the front flange 11 of the rear cover 1 for sealing the front and rear covers 3, 1 for water-proof purpose (FIG. 5).

An outer packing ring 7 is further provided to fasten and seal the flange 31 of the front cover 3 and the front flange 11 of the rear cover 1 for further enhancing water proof effect between the front and rear covers 3, 1.

The packing ring 6, 7 may be made of rubber materials or any other packing or sealing materials, not limited in the present invention.

By the way, the LEDs and the power supply circuit in the interior between the front and rear covers 3, 1 will not be attacked by moisture or pollutants as sealed by the plural packing rings 6, 7 of the present invention.

Figure 2:
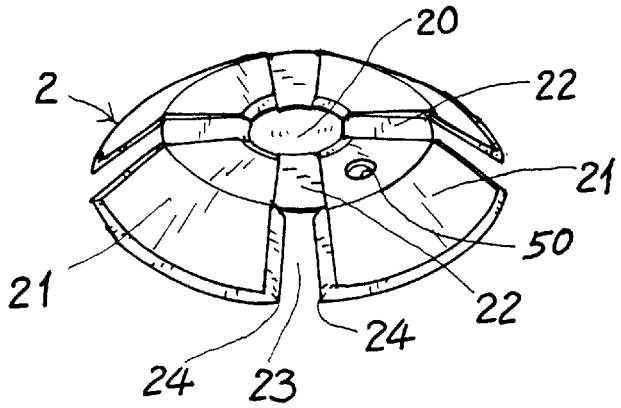
FIG. 2 is a perspective view of the heat-dissipating device of the present invention.

The heat-dissipating device 2 of the present invention, especially as shown in FIG. 2, includes: a plurality of heat-dissipating members 21 made of heat conductive metals (including aluminum alloy) and branched radially from a central portion 20, with every two neighboring heat-dissipating members 21 partitioning with each other with a notch 23 defined between the two neighboring heat-dissipating members 21, whereby upon plastic molding process by molding plastic resin into the notches 23 among the heat-dissipating members 21, the heat-dissipating members 21 will be integrally formed with the plastic resin molded into each notch 23 between every two neighboring heat-dissipating members 21 to form a smooth rear cover 1 (FIG. 3) by integrally forming the heat-dissipating device 2 with the rear portion 12 of the rear cover 1.

A thin web portion 22 may be integrally linked or formed between every two neighboring heat-dissipating members 21 to enhance the strength of the heat-dissipating device 2 consisting of the plural heat-dissipating members 21, each thin web portion 22 having a thickness thinner than that of each heat-dissipating member 21 to allow the plastic resin material to be molded or coated on the thin web portion 22, namely, the web portion 22 serving as a "substrate" to be coated with resin material thereon during the plastic molding process.

Figure 3:
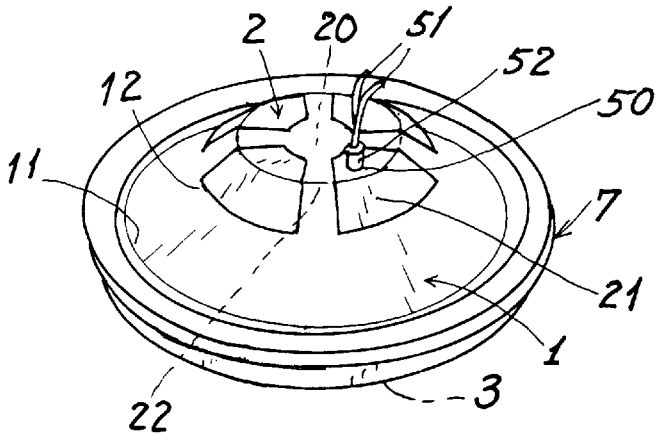
FIG. 3 is an illustration showing the present invention when assembled.
Figure 4:
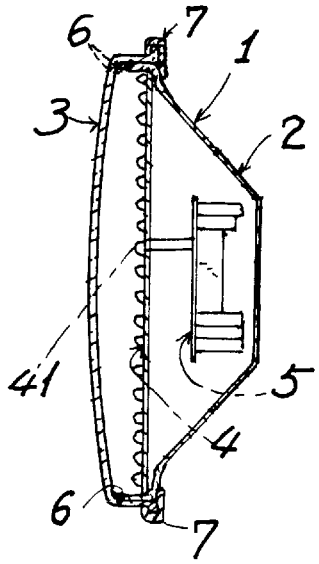
FIG. 4 is a sectional drawing of the present invention.

Meanwhile, the central portion 20 of the heat-dissipating device 2 may also be formed as a thin substrate having a thickness thinner than that of each heat-dissipating member 21 so that after plastic molding process, the plastic resin material of the rear cover 1 may be coated on the central portion 20 with thin substrate to form a smooth surface of rear cover 1 and the heat-dissipating device 2 as shown in FIGS. 1, 3.

Each heat-dissipating member 21 includes a thin periphery 24 having a thickness thinner than that of each heat-dissipating member 21 to allow the plastic resin material to be molded and coated on the thin periphery 24 disposed around each heat-dissipating member 21 and to also impregnate and fill the plastic resin material into each notch 23 between every two neighboring heat-dissipating members 21 to form a smooth surface of the rear cover 1 integrally formed with the heat-dissipating device 2.

Accordingly, the heat-dissipating device 2 having the plural heat-dissipating members 21 made of heat conductive metals as formed on the rear cover 1 will dissipate the heat as produced or accumulated from the interior within the rear and front covers 1, 3 for cooling the whole set of LED traffic signal light for maintaining a good traffic warning and signalling function and also for prolonging the service life of the traffic light.

The metallic heat-dissipating device 2 is integrally formed with the rear cover 1 to form a smooth housing surface for enhancing the ornamental effect of the light.

The heat-dissipating device 2 may be pressed or molded by mechanical processing from a single metal sheet for facilitating the production of the device 2. The aforementioned thin portions 20, 22, 24 of the device 2 may also be recessed downwardly (or inwardly) from the device 2 formed as a single plate.

Figure 6:
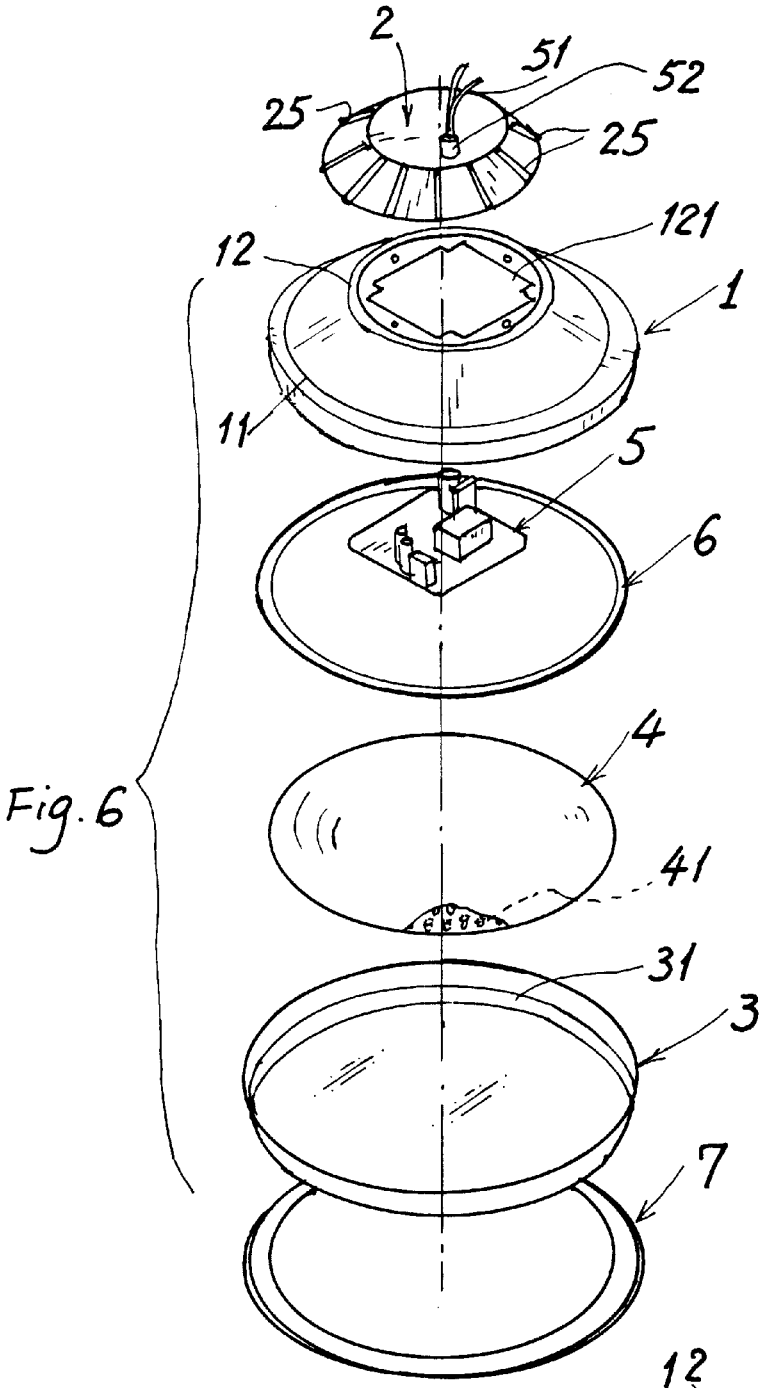
FIG. 6 shows another preferred embodiment of the present invention, especially showing the rear cover and the heat-dissipating device.
Figure 7:
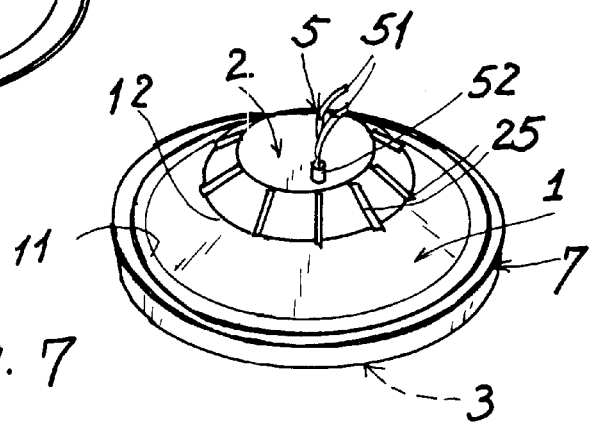
FIG. 7 is a perspective view of the present invention when incorporating the rear cover as shown in FIG. 6
Figure 8:
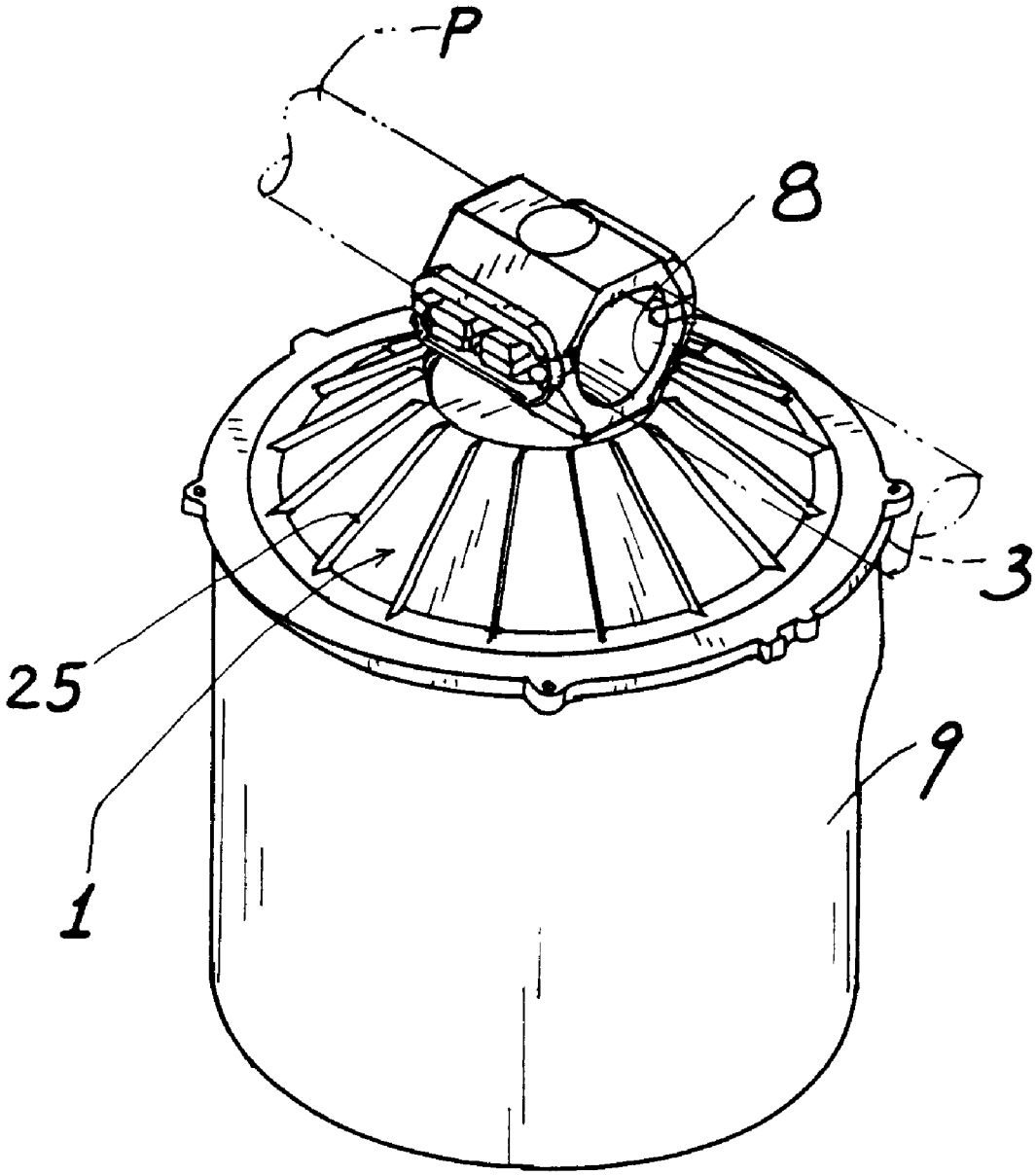
FIG. 8 is an illustration showing a bracket provided to be secured on a post.

As shown in FIGS. 6, 7, the heat-dissipating device 2 may be modified to be a metallic cup (or cap) member encasing a rear opening 121 formed in the rear portion 12 of the rear cover 1, with the metallic cup member having a plurality of fins 25 integrally formed on the metallic cup member to enhance the heat dissipation efficiency.

Naturally, the whole rear cover 1 may be however formed as a heat-conductive metallic cover for heat dissipation purpose.

The present invention is superior to the conventional LED traffic signal light with the following advantages:

1. The housing or the rear cover 1 has been integrally formed with the heat-dissipating device 2 for effectively dissipating the heat as produced from the light for prolonging the service life of the light.

2. Plural packing rings are provided to seal any aperture between the front and rear covers for well obtaining water proof effect of the light.

The heat-dissipating device 2 as made of heat-conductive materials may be further formed with extension ribs (not shown) on the heat-dissipating device formed as a cup encasing on the rear portion 12 of the rear cover 1, with each extension rib also having further (or double) duty to serve as a heat-radiating fin for enhancing cooling effectt.

The rear cover 1 may be further formed or integrally formed with brackets 8 to be secured on a post P, and a front shade 9 is secured with the front cover 3.

The present invention may be modified without departing from the spirit and scope of the present invention. The configurations or arrangements for the engaging parts of the rear cover 1 and the front cover 3 may, for instance, be modified to be tenon and socket, male and female engagement and many other design choices for joining the covers in cooperation with the plural packing or sealing rings each packed between the two covers 1, 3.

I claim:

1. A heat-dissipating LED traffic signal light comprising:

a rear cover having a heat-dissipating device formed on said rear cover;

a front cover combined with said rear cover for encasing a LED printed circuit board having a plurality of LEDs formed on the board and a power supply circuit device in between said front and rear covers:

said heat-dissipating device made of heat conductive metal and integrally formed with said rear cover; whereby upon producing of heat from the traffic light, the heat will be dissipated outwardly by said heat-dissipating device as formed on said rear cover.

2. A LED traffic signal light according to claim 1, wherein said heat-dissipating device includes: a plurality of heat-dissipating members made of heat conductive metals and branched radially from a central portion, with every two neighboring heat-dissipating members partitioning with each other with a notch defined between the two neighboring heat-dissipating members, whereby upon plastic molding process by molding plastic resin into the notches among the heat-dissipating members, the heat-dissipating members will be integrally formed with the plastic resin molded into each said notch between every two neighboring heat-dissipating members to form a smooth surface of said rear cover and said heat-dissipating device.

3. A LED traffic signal light according to claim 2, wherein said heat-dissipating device further includes a web portion integrally linked and formed between every two neighboring heat-dissipating members to enhance the strength of the heat-dissipating device consisting of the plural heat-dissipating members, each said web portion having a thickness thinner than that of each said heat-dissipating member or each said web portion recessed from said heat-dissipating device to coat the plastic resin material on the thin web portion.

4. A LED traffic signal light according to claim 2, wherein said central portion of the heat-dissipating device is formed as a thin substrate having a thickness thinner than that of each said heat-dissipating member or said central portion recessed from said heat-dissipating device, whereby upon plastic molding, the central portion will be coated with plastic material thereon to form a smooth surface of said rear cover and said heat-dissipating device.

5. A LED traffic signal light according to claim 2, wherein each said heat-dissipating member includes a periphery having a thickness thinner than that of each said heat-dissipating member or recessed from said heat-dissipating member to allow the plastic resin material to be molded and coated on the periphery disposed around each said heat-dissipating member and to impregnate and fill the plastic resin material into each said notch formed between every two neighboring heat-dissipating members to form a smooth surface of the rear cover and the heat-dissipating device.

6. A LED traffic signal light according to claim 1, wherein said heat-dissipating device includes a heat-conductive metallic cup member covering a rear opening formed in a rear portion of the rear cover.

7. A LED traffic signal light according to claim 6, wherein said metallic cup member includes a plurality of heat-dissipating fins integrally formed on the metallic cup member.

8. A LED traffic signal light according to claim 1, wherein said power supply circuit device includes two electric wires connected to a utility power source, a sealing plug encasing the two electric wires in the plug as sealed by a sealant; said sealing plug inserted into an interior in between the rear cover and the front cover through a plug hole formed through the rear cover and having a sealant sealing an aperture between the plug and the plug hole in the rear cover.

9. A LED traffic signal light according to claim 1, wherein said rear cover includes a front flange circumferentially formed on a front perimeter of the rear cover, and a rear portion of said rear cover protruding rearwardly from the front flange; and said front cover including a flange circumferentially formed on a rim of the front cover and engaged with the front flange of the rear cover having an inner packing ring packed in between the flange of the front cover and the front flange of the rear cover for sealing an aperture between the front and rear covers for water proof.

10. A LED traffic signal light according to claim 9, wherein said signal light includes an outer packing ring provided to fasten and seal the flange of the front cover and the front flange of the rear cover for enhancing water proof between the front and rear covers.

11. A LED traffic signal light according to claim 1, wherein said heat conductive metal is aluminum alloy.

12. A heat-dissipating LED traffic signal light comprising:

a rear cover formed as a heat-dissipating cup member and made of heat conductive metal; and a front cover combined with said rear cover formed as heat-dissipating cup member for encasing a LED printed circuit board having a plurality of LEDs formed on the board and a power supply circuit device in between said front and rear covers.

13. A LED traffic signal light according to claim 12, wherein said rear cover further includes a plurality of heat-dissipating fins integrally formed on said rear cover.

14. A LED traffic signal light according to claim 1, wherein said rear cover is formed with a bracket to be secured on a post.

* * * * *